US008763725B2

(12) United States Patent
Downton

(10) Patent No.: US 8,763,725 B2
(45) Date of Patent: Jul. 1, 2014

(54) ROTARY STEERABLE DRILLING SYSTEM

(75) Inventor: Geoffrey C. Downton, Stroud (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 772 days.

(21) Appl. No.: 12/664,859

(22) PCT Filed: Jun. 25, 2008

(86) PCT No.: PCT/US2008/068100
§ 371 (c)(1),
(2), (4) Date: Jul. 28, 2011

(87) PCT Pub. No.: WO2009/002996
PCT Pub. Date: Dec. 31, 2008

(65) Prior Publication Data

US 2012/0145458 A1 Jun. 14, 2012

(30) Foreign Application Priority Data

Jun. 26, 2007 (GB) ..... 0712340.9

(51) Int. Cl.
*E21B 7/04* (2006.01)

(52) U.S. Cl.
USPC ..... 175/73; 175/61

(58) Field of Classification Search
USPC ..... 166/50, 73, 231; 175/50, 73, 231, 115, 175/264, 76, 107, 61
See application file for complete search history.

(56) References Cited

U.S. PATENT DOCUMENTS

| | | | | |
|---|---|---|---|---|
| 3,465,834 | A | 9/1969 | Southworth et al. | |
| 4,665,995 | A * | 5/1987 | Braithwaite et al. | 175/45 |
| 5,113,953 | A * | 5/1992 | Noble | 175/61 |
| 5,168,941 | A * | 12/1992 | Krueger et al. | 175/26 |
| 5,318,138 | A * | 6/1994 | Dewey et al. | 175/74 |
| 5,485,889 | A * | 1/1996 | Gray | 175/61 |
| 5,573,777 | A | 11/1996 | Serpelloni et al. | |
| 5,931,239 | A | 8/1999 | Schuh | |
| 6,116,354 | A * | 9/2000 | Buytaert | 175/55 |
| 6,470,974 | B1 * | 10/2002 | Moore et al. | 175/45 |
| 6,516,900 | B1 * | 2/2003 | Tokle | 175/73 |
| 6,598,687 | B2 * | 7/2003 | Eppink et al. | 175/73 |
| 6,607,044 | B1 * | 8/2003 | Eppink et al. | 175/61 |

(Continued)

FOREIGN PATENT DOCUMENTS

| | | |
|---|---|---|
| EP | 1734606 | 12/2006 |
| GB | 2406110 | 3/2005 |

(Continued)

OTHER PUBLICATIONS

B.N. Lokotosh, et al, "Automation of the drilling process of deep boreholes", Lvov. 1977 p. 205 (cited in the office action for the equivalent Russian patent application No. 2010102246 issued on Apr. 25, 2012).

(Continued)

*Primary Examiner* — Kenneth L Thompson
*Assistant Examiner* — Michael Wills, III
(74) *Attorney, Agent, or Firm* — Chadwick A. Sullivan; Brigitte Echols

(57) ABSTRACT

A rotary steerable drilling system comprises a rotatable housing having a plurality of steering actuators mounted thereon and movable, individually, between retracted and extended positions, the actuators being electrically controlled, and a battery arranged to supply electrical power to the actuators.

11 Claims, 1 Drawing Sheet

(56) References Cited

U.S. PATENT DOCUMENTS

| | | | | |
|---|---|---|---|---|
| 6,717,501 | B2 * | 4/2004 | Hall et al. | 336/132 |
| 6,843,332 | B2 * | 1/2005 | Eppink et al. | 175/73 |
| 7,188,685 | B2 | 3/2007 | Downton et al. | |
| 7,287,605 | B2 * | 10/2007 | Van Steenwyk et al. | 175/61 |
| 7,950,473 | B2 * | 5/2011 | Sugiura | 175/45 |
| 2001/0052428 | A1 * | 12/2001 | Larronde et al. | 175/61 |
| 2002/0139584 | A1 * | 10/2002 | Hughes et al. | 175/107 |
| 2003/0121702 | A1 * | 7/2003 | Downton et al. | 175/76 |
| 2003/0127252 | A1 * | 7/2003 | Downton et al. | 175/73 |
| 2005/0109542 | A1 | 5/2005 | Downton | |
| 2006/0249287 | A1 * | 11/2006 | Downton et al. | 166/250.1 |
| 2007/0029112 | A1 * | 2/2007 | Li et al. | 175/26 |
| 2007/0151767 | A1 | 7/2007 | Downton | |
| 2008/0053707 | A1 * | 3/2008 | Martinez et al. | 175/73 |
| 2010/0108382 | A1 * | 5/2010 | Ma et al. | 175/24 |

FOREIGN PATENT DOCUMENTS

| | | |
|---|---|---|
| GB | 2408526 | 6/2005 |
| GB | 2408757 | 6/2005 |
| GB | 2425790 | 11/2006 |
| GB | 2433082 | 6/2007 |
| RU | 2256074 | 2/2004 |
| WO | 96/36788 | 11/1996 |
| WO | 00/46479 | 8/2000 |
| WO | 03/052237 | 6/2003 |
| WO | 03/089759 | 10/2003 |
| WO | 2006/060673 | 6/2006 |
| WO | 2007036722 | 4/2007 |

OTHER PUBLICATIONS

Office action for the equivalent Russian patent application No. 2010102246 issued on Apr. 25, 2012.

* cited by examiner

ROTARY STEERABLE DRILLING SYSTEM

BACKGROUND TO THE INVENTION

This invention relates to a rotary steerable drilling system for use in the drilling of boreholes.

SUMMARY OF THE INVENTION

Rotary steerable drilling systems are known in which a housing having a plurality of bias pads mounted thereon is adapted to be rotated, in use. Each bias pad is movable between a retracted position and an extended position. When in its extended position, the bias pad bears against the wall of the borehole and the resulting reaction force applies a laterally directed force to the housing which can be used in achieving steering. As the housing rotates substantially continuously, in use, it will be appreciated that the bias pads must be extended and retracted in turn in synchronism with the rotation of the housing in order for the applied laterally directed force to be applied in a substantially uniform direction.

The bias pads are typically moved by piston arrangements, valves being provided to control the supply of fluid to the piston. In the past the valves have been incorporated into a single rotary control valve. The torquer devices or the like used in controlling the operation of the rotary valves consume significant quantities of electrical power. In order to provide the necessary power levels, downhole located generators have been used. Other arrangements involve the use of electromagnetically actuated valves, for example of bistable form, which consume significantly less electrical power.

Another form of steerable drilling system uses a rotatable drill bit mounted upon a bent housing or sub. By controlling the angular position of the bent housing or sub, the bit can be pointed in a direction in which drilling is desired.

A further form of steerable drilling systems is a hybrid of the above-described arrangements, comprising a rotatable collar, a sleeve mounted on the collar so as to be rotatable therewith, a universal joint permitting angular movement of the sleeve relative to the collar to allow tilting of the axis of the sleeve relative to that of the collar. Actuators control the relative angles of the axes of the sleeve and the collar. By appropriate control of the actuators, the sleeve can be held in substantially a desired orientation whilst the collar rotates. A hybrid system of this type is described in, for example, GB 2406110.

According to the present invention there is provided a rotary steerable drilling system comprising a rotatable housing having a plurality of steering actuators mounted thereon and movable, individually, between retracted and extended positions, the actuators being electrically controlled, and a battery arranged to supply electrical power to the actuators.

The actuators conveniently include pistons and valves controlling fluid supply to the pistons, the valves being electrically controlled. Preferably, the actuators are bistable. Consequently, little electrical power is consumed and a battery can provide the required power. The battery is conveniently rechargeable, for example by being electrically connected to a surface located or otherwise located power source.

In addition to supplying power to the actuators, the battery may also power other equipment. For example, it may be used to power an actuator used to transmit data to the surface or downhole from the surface.

The system conveniently further includes a downhole drilling fluid operated motor, for example for driving the drill bit for rotation or for use in orientating other downhole components.

Where the battery is rechargeable by being connected to the surface, the connection may be made using a wired drill pipe arrangement.

The drilling system may be of the type in which operation of the actuators is used to drive one or more bias pads against the surface of a borehole, the resulting reaction force urging the rotatable housing, together with a drill bit mounted thereon, laterally to form a deviation, dogleg or curve in the borehole.

Alternatively, the drilling system may be of the hybrid type, the operation of the actuators serving to control the angular position of the axis of a sleeve relative to that of a collar.

BRIEF DESCRIPTION OF THE DRAWINGS

The invention will further be described, by way of example, with reference to the accompanying drawings, in which.

DETAILED DESCRIPTION OF THE DRAWINGS

Figure 1:
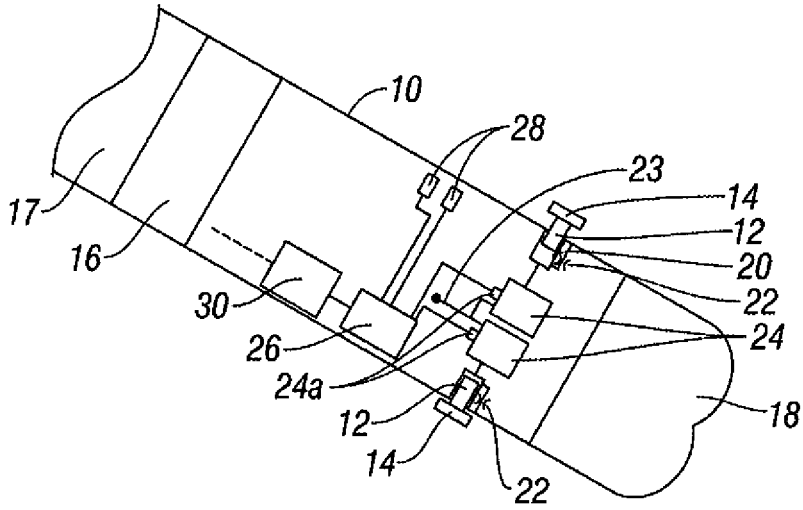
FIG. 1 is a diagrammatic view illustrating part of a steerable drilling system.

Referring firstly to FIG. 1 there is illustrated, diagrammatically, part of a downhole steerable drilling system comprising a sleeve or housing 10 having pistons 12 associated therewith, each piston 12 being movable to move an associated bias pad 14 between an extended, radially outward position and a retracted position. At an end of the housing 10 is located a downhole motor 16, conveniently in the form of a drilling fluid or mud powered motor, operable to drive the housing 10 for rotation. The motor 16 is carried by the drill string 17 which is rotated, in use, for example by a surface located motor or by a downhole motor. A drill bit 18 is mounted at an end of the housing 10 so that rotation of the housing 10 drives the drill bit 18 for rotation.

The pistons 12 are moved from their retracted positions toward their extended positions by supplying drilling fluid, under pressure, to the cylinders 20 associated therewith, return movement occurring as the drilling fluid is able to escape, at a restricted rate, from the cylinders 20, for example along restricted flow paths 22.

The supply of fluid to the cylinders 20 from a high pressure line 23 is controlled by control valves 24, the operation of which is controlled by a control unit 26 using information derived from, for example, inclination and azimuth sensors 28. The control valves 24, control unit 26 and sensors 28 are electrically powered from a load cell or battery 30.

In use, drilling fluid is supplied to the system, causing the motor 16 to drive the housing 10 and bit 18 for rotation. The rotation of the bit 18, in combination with an applied weight on bit load causes the bit 18 to scrape or otherwise remove formation material, increasing the length of a borehole being formed. The removed material is carried away by the drilling fluid.

To achieve steering of the drilling direction, the control unit 26 controls the valves 24 so as to determine which, if any, of the pistons 12 and associated pads 14 occupies its extended position at any given time. It will be appreciated that by urging a selected one of the pads 14 towards its extended position and into engagement with the wall of the borehole, a laterally acting reaction force is applied to the housing 10 and hence to the bit 18. By moving the pads 14, in turn, as the housing 10 rotates, the reaction force can be applied in a substantially constant direction resulting in the formation of a curve or dogleg in the borehole.

The valves 24 are conveniently electromagnetically controlled, preferably using bistable electromagnetic actuators 24*a*. Suitable valves and actuators are described in The use of bistable actuators 24*a* is advantageous in that electrical power is only consumed during switching of the actuators 24*a* between their stable positions, power not being consumed in holding the actuators 24*a* in the stable positions. Consequently, in use, little power is consumed and the battery 30 is capable of powering the actuators 24*a* for a period of time.

The battery 30 may be removably mounted so as to allow replacement thereof, when desired, for example by being conveyed on a wire. Thus, for example, when it is determined that the stored power is running low, the battery can be removed and replaced by a fully charged battery. Alternatively, the battery 30 may be rechargeable and arranged to be charged in situ. For example, it could be recharged using an electrical cable lowered from the surface, when required, and connected to the battery 30. Alternatively, it may be recharged using a wired drill pipe link in the drill string 17 connected to a power source located at the surface or elsewhere.

Although illustrated as being located adjacent the control unit 26 and valves 24, the battery 30 may be located remotely and connected thereto using, for example, a wired drill pipe link.

As well as being used to power the actuators 24*a* and valves 24, the battery power may be used to control or power a number of other devices. For example, it may be used to power a pressure sensor for use in receiving data transmitted in the form of pressure pulses in the drilling fluid. It could alternatively or additionally be used to power an actuator, conveniently a bistable actuator, serving as a hydraulic power source or controller for a mechanism used to induce positive or negative pressure pulses in the drilling fluid, either within the housing or in the annulus between the housing and the wall of the borehole, which pressure pulses can be used to transmit information to a remote location. The mechanism may include a magnet which, in use, moves relative to a coil thereby generating electrical power.

Figure 2:
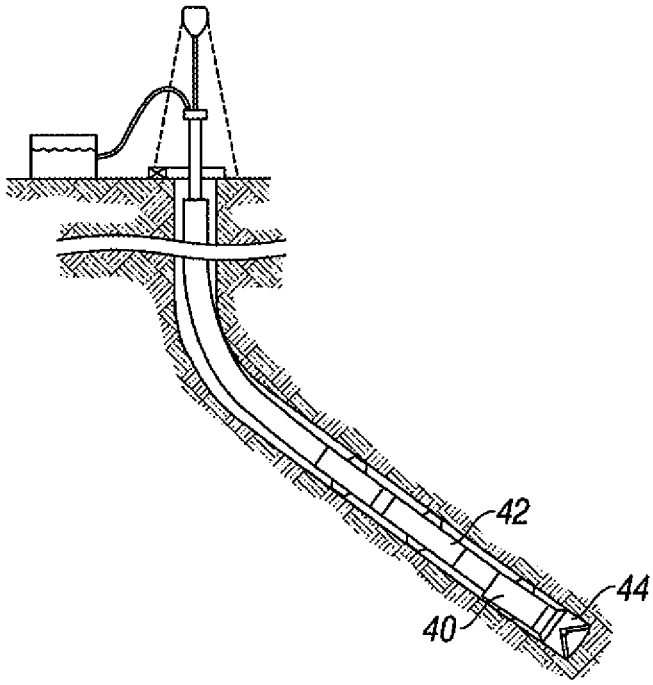
FIGS. 2 and 3 illustrate an alternative drilling system.
Figure 3:
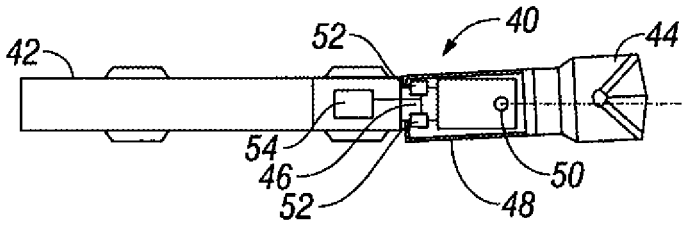

FIGS. 2 and 3 illustrate an alternative form of steerable drilling system which comprises a hybrid steering unit 40 carried by a rotatable drill string 42 and arranged to carry a drill bit 44. The unit 40 comprises a collar 46 connected to the drill string 42 and a sleeve 48 connected to the collar 46 by a universal joint 50 such that rotary motion of the collar 46 is transmitted to the sleeve 48, whilst permitting adjustment of the angle of the axis of the sleeve 48, and the drill bit 44 connected thereto, relative to that of the collar 46.

Actuators 52 are mounted on the collar 46 and co-operate with the sleeve 48 to control the angular position of the sleeve 48. The actuators 48, 52 conveniently comprise pistons and associated control valves, and are preferably bistable, the actuators being electrically controlled and drawing electrical power from a battery 54. The battery 54 may be replaceable and/or re-chargeable using any of the previously described techniques.

The battery 54 may also supply power to a sensor, for example a sleeve mounted angle sensor, indicative of the relative angles of the collar 46 and sleeve 48. The angle sensor may be similar to a wired drill pipe coupling, using variations in the coupling to provide the angle information.

In any of the arrangements described hereinbefore, where a wire drill pipe is provided, the wired drill pipe may be used to form a power and/or signal bus for the entire downhole tool. It may be used to transmit power and/or signals to the sleeve, in an arrangement of the type shown in FIGS. 2 and 3, and/or across a downhole motor, for example a mud powered motor. The battery may power the wired drill pipe power/signal transmission signal.

In the arrangements described hereinbefore, a wired drill pipe connection may be used to upload and/or download data or program information to or from the downhole tool.

The actuators of the arrangements described hereinbefore for use in controlling steering may also incorporate actuators operable to generate pressure waves in the drilling fluid, which pressure waves can be sensed at a remote location thereby allowing the transmission of date from the bottom hole assembly to, for example, the surface. Alternatively, such actuators may be located in a separate housing or sub and may be connected via a wired drill pipe connection to allow power and/or data signals to be supplied thereto.

In any of the arrangements described hereinbefore, the battery may be used to power a drilling mechanics module which may be connected via a wired drill pipe data bus, and hence may be located remotely from the steering tool.

A pressure transducer may be provided to monitor the drilling fluid pressure change across a restriction connected to the wired drilling pipe to measure flow rate. A bistable actuator may be used to isolate the supply of drilling fluid to the pistons in the event of an over pressure event being sensed, for example due to nozzles having become blocked.

In any of the arrangements described hereinbefore, the bistable actuator control unit and pulser may be dimensioned to fit within a collar of diameter for 75 mm upwards.

Although not illustrated in the accompanying drawings, the arrangement of FIGS. 2 and 3 may incorporate a motor operable to rotate the collar 46, sleeve 48 and bit 44. For example, the collar 46 may be mounted upon or otherwise connected to the driveshaft of the motor and be laterally supported upon radial bearings and thrust bearings. Pressurised drilling fluid for use in the actuators 52 may be supplied from the remote end of the motor via a passage formed in the rotor thereof and through the driveshaft. The driveshaft is conveniently of a flexible titanium material.

In an alternative configuration, the actuators 52 may be mounted upon the stator of the motor, the control unit for the actuators 52 being located above the motor and conveying fluid under pressure through passages formed in the stator to the actuators 52. A flexible driveshaft connected to the rotor of the motor may pass through the universal joint, supported upon radial bearings, to drive the drill bit 44 which is supported upon thrust bearings on the sleeve 48.

Alternatively, the sleeve 48 may be connected to the rotor of the motor and thereby rotate the bit. In such an arrangement there will be sliding contact between the actuators 52 and the sleeve and this will borne by a drilling fluid or oil lubricated bearing. In such an arrangement it may be desirable to provide sensors to measure the angle of the sleeve 48 relative to the collar 46, the sensor conveniently being mounted upon the stator of the motor.

As in conventional systems, the motor drive system is conveniently suspended in the borehole on a drill pipe, coil tubing, composite tubing, wire line or tractor system or any combination of these. The borehole may be drilled at any appropriate temperature or pressure, and the system may be driven by mud, mist, and gas of any appropriate density or viscosity. The borehole pressure may be less than, equal to or greater than the formation pressure, and the system may be exposed to LCM. The system may be used in the drilling of any earth formation and the borehole may be of any desired diameter, and may be used in underbalanced drilling conditions. The tool may be operated with a formation evaluation tool if desired. The bistable actuator may be connected to a bypass channel which extends along the centre of the rotor of the motor and may use the pressure as created by interrupting the flow of fluid through this bypass channel to transmit information to the surface.

A small turbine may be used to charge the battery and may also receive downlink information from the surface.

A rotary speed sensor on equipment located below the motor may receive downlink information by converting variations in drilling fluid flow rate at the surface to rotary speed variations down holed by monitoring variations in the operating speed of the motor.

It will be appreciated that a wide range of modifications and alterations may be may to the examples or embodiments of the invention described hereinbefore without departing from the scope of the invention.

The invention claimed is:

1. A rotary steerable drilling system comprising:

a rotatable housing having a plurality of pistons mounted thereon for reciprocal movement in a radial direction to provide steering inputs;

a plurality of valves positioned to control a flow of high-pressure fluid to individual pistons of the plurality of pistons, the plurality of valves being electrically actuated;

a control unit to control actuation of the plurality of valves during rotation of the rotatable housing, the control unit receiving drilling information from inclination and azimuth sensors, the control unit and the inclination and azimuth sensors being electrically powered;

a battery positioned downhole during operation of the rotary steerable drilling system to supply electrical power to the valves for controlling actuation of the plurality of pistons, the battery also supplying electrical power to the control unit and the inclination and azimuth sensors; and a sleeve disposed around the plurality of pistons, the sleeve being pivotably mounted to a collar of the rotatable housing by a universal joint, the sleeve being coupled to a drill bit such that actuation of the pistons between retracted and extended positions causes adjustment of the angle of the axis of the sleeve, and the drill bit attached thereto, relative to the axis of the collar.

2. A system according to claim 1, where the plurality of valves is actuated via actuators which are bi-stable.

3. A system according to claim 1, wherein the battery is rechargeable.

4. A system according to claim 3, wherein the battery is rechargeable by being electrically connected to a surface located or otherwise located power source.

5. A system according to claim 1, wherein the battery also supplies power to other equipment.

6. A system according to claim 5, wherein the battery supplies power to communications equipment.

7. A system according to claim 1, further comprising a downhole drilling fluid operated motor.

8. A system according to claim 1, further comprising a wired drilling pipe connection arrangement whereby electrical power and/or data signals can be transmitted between components of the system.

9. A system according to claim 1, wherein a downhole motor is connected to the sleeve and is operable to drive the drill bit for rotation.

10. A system according to claim 1, wherein a downhole motor is connected to the collar and is operable to drive the sleeve for rotation relative to the collar.

11. A system according to claim 1, wherein a downhole motor is operable to drive the collar for rotation.

* * * * *